United States Patent [19]

Jadwin

[11] 4,323,634

[45] Apr. 6, 1982

[54] ELECTROGRAPHIC TONER AND DEVELOPER COMPOSITION CONTAINING QUATERNARY AMMONIUM SALT CHARGE CONTROL AGENT

[75] Inventor: Thomas A. Jadwin, Rochester, N.Y.

[73] Assignee: Eastman Kodak Company, Rochester, N.Y.

[21] Appl. No.: 850,164

[22] Filed: Nov. 10, 1977

Related U.S. Application Data

[63] Continuation of Ser. No. 690,331, May 26, 1976, abandoned, and a continuation-in-part of Ser. No. 594,395, Jul. 9, 1975, abandoned.

[51] Int. Cl.[3] ..... G03G 9/08

[52] U.S. Cl. ..... 430/110; 430/115; 430/528; 260/DIG. 20

[58] Field of Search ..... 260/DIG. 20; 252/62.1; 430/110, 115

[56] References Cited

U.S. PATENT DOCUMENTS

| | | | |
|---|---|---|---|
| 2,626,876 | 1/1953 | Carnes | 260/D. 20 |
| 3,060,051 | 10/1962 | Johnson | 252/62.1 |
| 3,431,412 | 3/1969 | Okubo et al. | 252/62.1 |
| 3,729,418 | 4/1973 | Machida et al. | 252/62.1 L |

FOREIGN PATENT DOCUMENTS 1174573 12/1969 United Kingdom .

*Primary Examiner*—John D. Welsh
*Attorney, Agent, or Firm*—William T. French

[57] ABSTRACT

The present invention relates to the use of low levels of quaternary ammonium salt surfactants as charge control agents for an electrostatic toner contained in dry electrographic developer compositions. Particularly useful such charge control agents are those which contain at least one amido group having 10 or more carbon atoms attached to the ammonium cation and an anion selected from a halide ion or an organosulfur-containing anion.

10 Claims, 2 Drawing Figures

ELECTROGRAPHIC TONER AND DEVELOPER COMPOSITION CONTAINING QUATERNARY AMMONIUM SALT CHARGE CONTROL AGENT

This is a continuation, of application Ser. No. 690,331, filed May 26, 1976 now abandoned.

This application is a continuation-in-part of copending U.S. application Ser. No. 594,395 now abandoned, filed July 9, 1975 in the name of Thomas A. Jadwin.

BACKGROUND OF THE INVENTION

This invention relates to electrography and to a particulate toner composition and a dry electrographic developer composition containing such a toner useful in the development of latent electrostatic charge images.

Electrographic imaging and developing processes, e.g. electrophotographic imaging processes and techniques, have been extensively described in both the patent and other literature, for example, U.S. Pat. Nos. 2,221,776 issued Nov. 19, 1940; 2,277,013 issued Mar. 17, 1942; 2,297,691 issued Oct. 6, 1942; 2,357,809 issued Sept. 12, 1944; 2,551,582 issued May 8, 1951; 2,825,814 issued Mar. 4, 1958; 2,833,648 issued May 6, 1958; 3,220,324 issued Nov. 30, 1965; 3,220,831 issued Nov. 30, 1965; 3,220,833 issued Nov. 30, 1965; and many others. Generally these processes have in common the steps of forming a latent electrostatic charge image on an insulating electrographic element. The electrostatic latent image is then rendered visible by a development step in which the charged surface of the electrographic element is brought into contact with a suitable developer mix. Conventional dry developer mixes include toner or marking particles and may also include a carrier vehicle that can be either a magnetic material such as iron filings, powdered iron or iron oxide, or a triboelectrically chargeable, nonmagnetic substance like glass beads or crystals of inorganic salts such as sodium or potassium fluoride. The toner or marking particles typically contain a resinous material suitably colored or darkened, for contrast purposes, with a colorant like dyestuffs or pigments such as carbon black.

One method for applying a suitable dry developer mix to a charged image-bearing electrographic element is by the well-known magnetic brush process. Such a process generally utilizes an apparatus of the type described, for example, in U.S. Pat. No. 3,003,462 issued Oct. 10, 1961 and customarily comprises a non-magnetic rotatably mounted cylinder having fixed magnetic means mounted inside. The cylinder is arranged to rotate so that part of the surface is immersed in or otherwise contacted with a supply of developer mix. The granular mass comprising the developer mix is magnetically attracted to the surface of the cylinder. As the developer mix comes within the influence of the field generated by the magnetic means within the cylinder, particles thereof arrange themselves in bristle-like formations resembling a brush. The brush formations that are formed by the developer mix tend to conform to the lines of magnetic flux, standing erect in the vicinity of the poles and laying substantially flat when said mix is outside the environment of the magnetic poles. Within one revolution the continually rotating cylinder picks up developer mix from a supply source and returns part or all of this material to this supply. This mode of operation assures that fresh mix is always available to the surface of the charged electrographic element at its point of contact with the brush. In a typical rotational cycle, the roller performs the successive steps of developer mix pickup, brush formation, brush contact with the electrographic element, e.g. a photoconductive element, brush collapse and finally mix release.

In magnetic brush development, as well as in various other types of electrographic development wherein a dry triboelectric mixture of a particulate carrier vehicle and a toner powder are utilized, e.g., cascade development such as described in U.S. Pat. Nos. 2,638,416 and 2,618,552, it is advantageous to modify the triboelectric properties of the toner powder so that a uniform, stable relatively high net electrical charge may be imparted to the toner powder by the particulate carrier vehicle. It is also highly advantageous if the triboelectric properties of the toner powder remain fairly uniform even when the toner powder is used under widely varying relative humidity (RH) conditions.

A variety of methods and material for modifying the triboelectric properties of particulate toner particles have been proposed. For example, Olson, U.S. Pat. Nos. 3,647,696 issued Mar. 7, 1972 describes a uniform polarity resin electrostatic toner containing a mono- or difunctional organic acid nigrosine salt. The nigrosine salt described in U.S. Pat. No. 3,647,696 aids in providing a relatively high uniform net electrical charge to a toner powder containing such a nigrosine salt. However, subsequent testing and development relating to the use of such organic acid nigrosine salts has shown that such materials, when incorporated in a toner composition, contribute to a decrease in the adhesion of the toner particles to a suitable paper receiving sheet. For example, it has been found that when a toner image is transferred from a charge image-bearing electrographic element to a paper receiving sheet and fixed to the receiving sheet, the image formed on the receiving sheets tends to flake off when the sheet is bent or folded.

In addition, Greig U.S. Pat. No. 3,079,272, issued Feb. 26, 1963, describes the use of 4–5%, by weight, of anionic compounds, such as stearic acid, in "melt-form" developer compositions containing particulate toner particles to "improve the triboelectric charge relationship" between the toner particles. However, it has been found that fatty acids, such as stearic acid, when incorporated in dry toner formulations of a magnetic brush developer composition do not enable one to obtain a resultant developer in which a relatively high net positive electrical charge is imparted to the toner particles by the magnetic carrier particles. And, it has also been found that incorporation of fatty acids, such as stearic acid, in toner particles tends to decrease adhesion of such toner particles to suitable plain paper receiving sheets.

Other materials which have been employed as modifying agents for dry toner compositions include various long-chain anionic or cationic materials such as various surfactants. Typical of these surfactant materials are the long chain quaternary ammonium surfactants. The use of such materials is described, for example, in British Pat. No. 1,174,573 published Dec. 17, 1969, at page 2, column 2 through page 3. In addition, Jacknow et. al. U.S. Pat. No. 3,577,345 issued May 4, 1971, describes a solid metal salt of a fatty acid admixed with one of various other described solid additives as a useful modifying combination for a dry toner composition.

Still other materials which have been found useful as charge control agents for electrostatic toner compositions are certain non-surfactant, short-chain, quaternary ammonium salts, such as those described in *Research*

*Disclosure,* No. 10244, published October 1972 or in Jadwin et al U.S. Pat. No. 3,893,935 issued July 8, 1975, and certain alkoxylated amines, such as those described in Jadwin et al U.S. patent application Ser. No. 470,425, filed May 16, 1974. The aforementioned quaternary ammonium salts and alkoxylated amines have been found capable of providing relatively high, uniform net electrical charge to a toner powder in which these materials are incorporated without any substantial deleterious effect on the adhesion properties of the toner compositions.

Although the above-described non-surfactant short chain quaternary ammonium salts have been found quite useful, it would be desirable to have a charge control agent for a dry electrostatic developer composition which imparts even greater RH stability to the developer composition. In addition, it would be useful to find new charge control agents which, when incorporated in toner, provide other advantageous properties, such as a toner which, when admixed with carrier to form a developer, is capable of improved long-life electrographic print uniformity. Also, it would be desirable to find new charge control agents which exhibit higher decomposition temperatures than certain of the preferred charge control agents of the prior art, such as the above-described quaternary ammonium salts and alkoxylated amines.

In addition to the above-mentioned materials which have been used specifically to modify the triboelectric properties of electrostatic toner particles contained in dry electrographic developer compositions, British Pat. No. 1,169,703, dated Nov. 24, 1966, describes the use of relatively large amounts, i.e., from 2 to about 15 percent by weight, of various ammonium salts, including myristyl dimethyl ammonium ethyl sulphate and cetyl dimethyl ethyl ammonium ethyl sulphate as additives for conducting printing ink particles to increase the electrical conductivity thereof to a level generally less than $10^{10}$ ohm-cm.

SUMMARY OF THE INVENTION

In accordance with the present invention there is provided an improved dry particulate electrostatic toner composition and a dry developer composition containing said toner triboelectrically attractable to a particulate carrier vehicle. The improved toner composition of the invention comprises a polymeric binder and, dispersed in said binder as a charge control agent, a small amount, i.e. less than two percent by weight, of a quaternary ammonium salt surfactant comprising at least one amido group having 10 or more carbon atoms, preferably 10 to 17 carbon atoms, attached to the ammonium cation and an anion selected from a halide ion or an organosulfur-containing anion. Advantageously, a suitable colorant such as a pigment or dye may also be incorporated in the toner.

In accordance with one advantageous embodiment of the invention, it has been found that charge control agents particularly useful in the present invention are materials having the following formula:

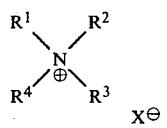

I.

wherein $R^1$, $R^2$, $R^3$ and $R^4$, which may be the same or different, each represents an aliphatic or aromatic organic group containing 1 to about 30 carbon atoms, providing that at least one of said $R^1$, $R^2$, $R^3$ or $R^4$ groups contains a long-chain amido group having 10 or more carbon atoms; and X represents a halide ion or an organosulfur-containing anion. The organosulfur-containing anion may conveniently be represented by the formula $R^5SO_n$ wherein $R^5$ represents an aliphatic or aromatic organo group, and n represents the integer 3 or 4. Especially useful such charge control agents are those which contain an amido group having from 10 to 17 carbon atoms.

DESCRIPTION OF THE PREFERRED EMBODIMENTS

Figure 1:
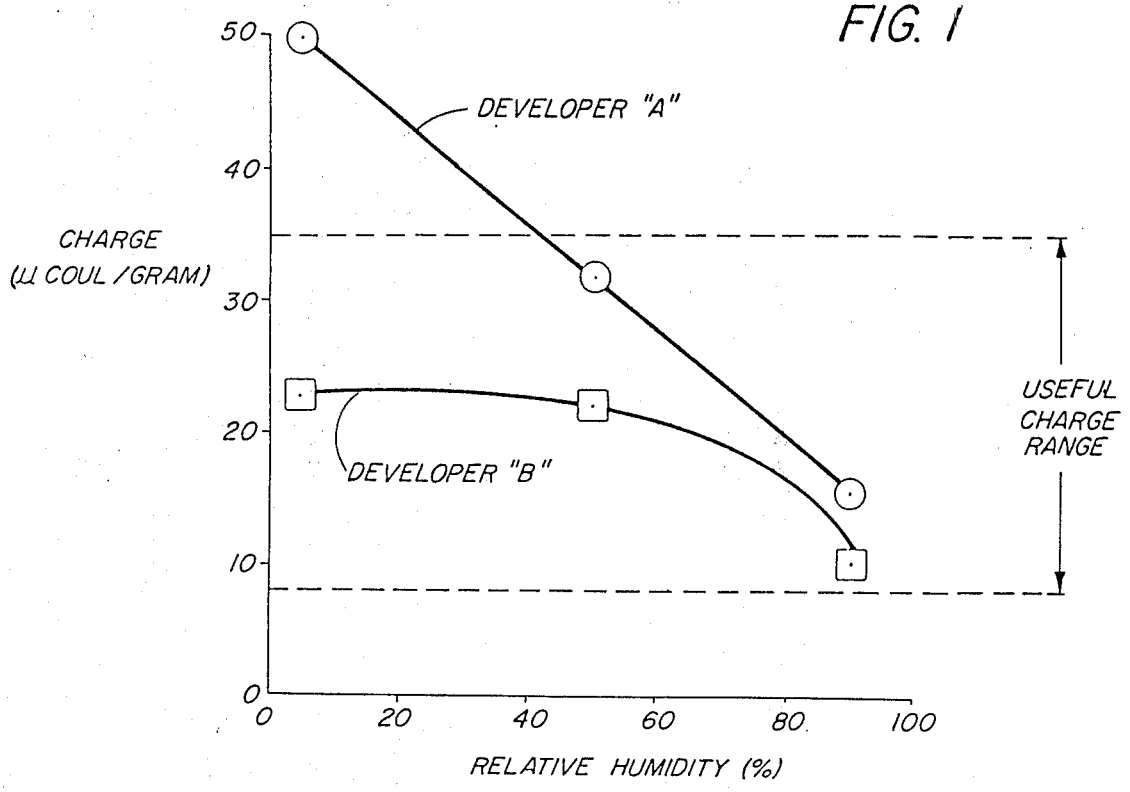
FIG. 1 is a graph illustrating the effect of increasing relative humidity (at 28° C.) on the net toner charge of two similar electrostatic developer composition, A and B, except that Developer A has a toner containing therein a prior art charge control agent of tetrapentylammonium chloride and Developer B has a toner containing therein a charge control agent of the present invention.

The present invention has been found to provide numerous advantages. Among others, the charge control agents used in the invention have been found to provide a dry, particulate toner composition which exhibits a relatively high, uniform and stable net toner charge when admixed with a suitable particulate carrier vehicle. Moreover, the amount of deleterious toner throw-off is generally quite low. In addition, the charge control agents used in the invention have been found to have no deleterious effect on the adhesion properties of the resultant toner composition containing these charge control agents when such toner compositions are fused to conventional plain paper receiving sheets.

In addition to the foregoing advantages, the charge control agents used in the present invention have been found even more effective at providing a resultant electrostatic toner composition which is capable of maintaining a relatively high, stable net toner charge level (when admixed with a particulate carrier vehicle under widely varying relative humidity (RH) conditions) than certain, somewhat similar prior art charge control agents, i.e. the short-chain (non-surfactant) quaternary ammonium salts described in Jadwin et al U.S. Pat. No. 3,893,935, issued July 8, 1975. This is particularly advantageous as it permits one to obtain effective electrographic development with low amounts of toner throw-off even at relatively low and high RH conditions, for example, 5% RH at 28° C. and 90% RH at 28° C.

It has further been found that toner particles containing an effective amount of the above-described charge control agents generally result in good to excellent electrographic developed images exhibiting good uniform density with little or no background scumming.

The polymers useful as binders in the practice of the present invention include those polymers and resins conventionally employed in electrostatic toner. Useful polymers generally have a glass transition temperature within the range of from 40° to 120° C. Preferably, toner particles prepared from these polymeric materials have relatively high caking temperature, for example, higher than about 55° C., so that the toner powders may be stored for relatively long periods of time at fairly high temperatures without having individual particles agglomerate and clump together. The softening temperature of useful polymers preferably is within the range of from about 40° C. to about 200° C. so that the toner particles can readily be fused to conventional paper receiving sheet to form a permanent image. Especially preferred polymers are those having a softening temperature within the range of from about 40° C. to about 65° C. because toners containing these binders can be used in high speed electrographic copy machines employing plain paper as the receiving sheet to which the toned images are fused. Of course, where other types of receiving elements are used, for example, metal plates such as certain printing plates, polymers having a softening temperature and glass transition temperature higher than the values specified above may be used.

As used herein the term "softening temperature" refers to the softening temperature of a polymer as measured by E. I. duPont de Nemours Company, Model 941 TMA (Thermal Mechanical Analyzer). Glass transition temperature (Tg) as used herein refers to the temperature at which a polymeric material changes from a glassy polymer to a rubbery polymer. This temperature (Tg) can be measured by differential thermal analysis as disclosed in *Techniques and Methods of Polymer Evaluation,* Vol. 1, Marcel Dekker, Inc., N.Y. 1966.

Among the various polymers which may be employed in the toner particles of the present invention are styrene-containing resins, polycarbonates, rosin modified maleic alkyd resins, polyamides, phenol-formaldehyde resins and various derivatives thereof, polyester condensates, modified alkyd resins and the like, aromatic resins containing alternating methylene and aromatic units such as described in Merrill et al, U.S. Pat. No. 3,809,554, issued May 7, 1974, and fusible cross-linked polymers as described in Jadwin et al, U.S. Ser. No. 498,818, filed Aug. 19, 1974, and the like.

Especially useful toner polymers include certain polycarbonates such as those described in U.S. Pat. No. 3,694,359 issued Sept. 26, 1972, and which includes polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful.

Still other especially useful toner polymers are various styrene-containing resins. Such polymers typically comprise a polymerized blend of from about 40 to about 100 percent by weight of styrene, including styrene homologs; from about 0 to about 45 percent by weight of one or more lower alkyl acrylates or methacrylates having from 1 to about 4 carbon atoms in the alkyl moiety such as methyl, ethyl, isopropyl, butyl, etc.; and from about 0 to about 50 percent by weight of one or more vinyl monomers other than styrene, for example, a higher alkyl acrylate or methacrylate (including branched alkyl and cycloalkyl acrylates and methacrylates) having from about 6 to 20 or more carbon atoms in the alkyl group. A typical styrene-containing polymer prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate. Especially useful styrene-containing binder resins are cross-linked fusible styrene-containing polymers such as described in the above-referenced Jadwin et. al. patent application. A variety of other useful styrene containing toner materials are disclosed in the following U.S. Pat. Nos. 2,917,460 issued Dec. 15, 1959; Re. 25,136 issued Mar. 13, 1962; 2,788,288 issued Apr. 9, 1957; 2,638,416 issued Apr. 12, 1953; 2,618,552 issued Nov. 18, 1952 and 2,659,670 issued Nov. 17, 1953.

The amount of binder polymer employed in the toner particles used in the present invention may vary depending on the amounts of other addenda which one may desire to incorporate in the toner composition. For example, various colorant and/or magnetic materials can advantageously be incorporated in the toner particles when the particles are desired for use in certain applications requiring such addenda. Typically, however, the binder polymer is present in an amount equal to or greater than about 50 percent by weight of the toner composition. And, in accord with certain particularly useful embodiments of the invention where it is desired to employ the resultant toner composition in a high speed electrographic office copy machine, it is desirable to use an amount of binder polymer within the range of from about 75 to about 98 weight percent based on the total weight of the particulate toner composition.

The toner particles of the present invention can be prepared by various methods. One convenient technique for preparing these toners is spray-drying. Spray-drying involves dissolving the binder polymer and adding the toner colorant and charge control agent to a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented resin. The ultimate particle size is determined by varying the size of the atomizing nozzle and the pressure of the gaseous atomizing agent. Particles of a diameter between about 0.1 micron and about 100 microns may be used; although, in general, present day office copy devices typically employ particles between about 1.0 and 30 microns. However, larger particles or smaller particles can be used where desired for particular methods of development or particular development conditions. For example, in powder cloud development such as described in U.S. Pat. No. 2,691,345 issued Oct. 12, 1954, extremely small toner particles on the order of about 0.01 microns may be used.

Another convenient method for preparing the toner composition of the present invention is melt-blending. This technique involves melting a powdered form of toner polymer or resin and mixing it with suitable colorants, such as dyes or pigments, and the charge control agent. The polymer can readily be melted on heated compounding rolls which are also useful to stir or otherwise blend the polymer and addenda so as to promote the complete intermixing of these various ingredients. After thorough blending, the mixture is cooled and solidified. The resultant solid mass is then broken into small particles and finely ground to form a free-flowing powder of toner particles. These particles typically have an average particle size or average diameter within the range of from about 0.1 to about 100 microns.

As described hereinabove the charge control agents used in the invention are added to the polymeric toner composition in an amount effective to improve the charge properties of the toner composition. The addition of a charge control agent improves the charge uniformity of a particular toner composition, i.e. acts to provide a toner composition in which all or substantially all of the individual discrete toner particles exhibit a triboelectric charge of the same sign (negative or positive) with respect to a given carrier vehicle, increases the net electrical charge exhibited by a specified quantity of toner particles relative to a given carrier vehicle, and reduces the amount of "toner throw-off" of a given toner composition. As used herein, the phrases "net electrical charge exhibited by a toner powder" or "net toner charge" are equivalent and are defined as the total electrical charge exhibited by a specified amount of a particular toner when admixed with a specified amount of a particular carrier vehicle. Although the phenomenon by which such an electrical charge is imparted is not fully understood, it is believed due in large part to the triboelectric effect caused by the physical admixture of toner and carrier. As used herein, the term "toner throw-off" is defined as the amount of toner powder thrown out of a developer mix as it is mechanically agitated, e.g., in a development apparatus. Aside from the extraneous contamination problems inherent with airborne toner dust in the development apparatus, "toner throw-off" also leads to imaging problems such as unwanted background and scumming of the electrographic image-bearing element.

The amount of the charge control agent useful in the present invention is important. Generally, it has been found desirable to employ an amount of charge control agent within the range of from about 0.01 to about 2 weight percent and preferably 0.2 to about 1.5 weight percent based on the total weight of the particulate toner composition. It has been found that if amounts much lower than those specified above are used, the charge control agent tends to exhibit little or substantially no improvement in the properties of the toner composition. As amounts more than about 1.5 weight percent of the charge control agent are used, especially amounts more than about 2.0 weight percent, it has been found that the net toner charge exhibited by the resultant toner composition becomes quite unstable and is substantially reduced. Of course, it must be recognized that the optimum amount of charge control agent to be added will depend in part on the particular charge control agent selected and the particular toner composition to which it is added. However, the amounts specified hereinabove are typical of the useful range of charge control agent of the present invention which can be effectively used in conventional dry toner materials.

As indicated, the control agents employed in the present invention are quaternary ammonium salt surfactants containing an amido group having at least 10 carbon atoms and an anion selected from a halide ion or an organosulfur-containing anion. The surfactant properties possessed by the charge agents used in the present invention are, in large part, attributable to the combined presence of one or more long-chain amido groups in the cationic portion of these quaternary ammonium salts. It is believed that this surfactant property is, in large part, responsible for the highly desirable charge control capability exhibited by these particular quaternary ammonium salt surfactants when used in the present invention. In accord with one useful embodiment of the invention, it has been found that the charge agents of the invention tend to provide best results when the concentration of the charge agent within an individual toner particle is greater at or near the surface of the particle than it is within the interior of the particle. Of course, useful results can also be obtained in accord with the present invention when the charge agents described herein are distributed in a uniform manner throughout the toner particle composition.

More specifically, the quaternary ammonium compounds used in the present invention have been found to exhibit excellent charge control characteristics even at very low relative humidities, e.g. 15% Rh or less. In contrast, the somewhat related short-chain, non-surfactant quaternary ammonium salt charge control agents described in copending Jadwin et al, U.S. Ser. No. 399,266, filed Sept. 20, 1973, although useful, do not provide nearly as effective charge control characteristics as is obtained by the charge control agents of the present invention at low relative humidities.

This is demonstrated in appended FIG. 1 which illustrates that at low relative humidities, toner compositions containing the aforementioned nonsurfactant charge control agents exhibit increasingly higher charge levels such that the toner composition quickly acquires a charge level outside of a useful magnetic brush developer charge range of about 8 to about 35 microcoulombs/gram. Of course, it will be appreciated that the useful charge range of a given type of electrostatic developer can vary depending, for example, upon whether one is using a cascade or magnetic brush developer, and even upon the specific developer system, e.g. one roll or two roll magnetic brush, with which one is working. In any case, however, the significant aspect of FIG. 1 is that it clearly shows that with toner particles containing the prior art short-chain, non-surfactant quaternary ammonium salt charge control agents, one can quickly reach a point under low, relative humidity conditions at which the toner particles are charged to an unacceptably high charge level. Toner particles exhibiting such a high charge tend to become so tightly bound, through electrostatic forces, to the carrier particles with which they are associated that it becomes extremely difficult to separate these toner particles from the carrier particles and into contact with the electrostatic images to be developed.

As indicated earlier herein, typical, representative charge agents of the present invention have the formula:

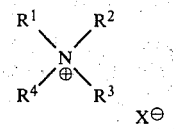

II.

wherein $R^1$, $R^2$, $R^3$ and $R^4$, which may be the same or different, each represent aliphatic or aromatic groups containing 1 to about 30 carbon atoms, providing that at least one of said $R^1$, $R^2$, $R^3$ or $R^4$ groups contains a long-chain amido group having 10 or more carbon atoms; and X is a halide ion or an organosulfur-containing anion. The organosulfur-containing anion may conveniently be represented by the formula $R^5SO_n$ wherein:

$R^5$ represents an aliphatic or aromatic organo group, and n represents the integer 3 or 4.

An especially useful class of the charge agents in accord with the present invention are materials having formula II above and wherein one of said $R^1$, $R^2$, $R^3$ or $R^4$ groups is a long chain organo-amido group having the formula:

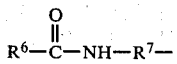

III.

wherein $R^6$ is an alkyl group having 7 or more carbon atoms and $R^7$ is a straight-chain alkylene group having 1 to about 8 carbon atoms and the remaining of said $R^1$, $R^2$, $R^3$ and $R^4$ groups are the same or different, each representing an unsubstituted lower alkyl group having from 1 to about 4 carbon atoms. Particularly preferred are the charge agents containing an organo-amido group having from 10 to about 17 carbon atoms. The amido group present in the long-chain organo groups of formula III appear to contribute to the surfactant properties of the resultant charge agents and also to the charge agent properties of the surfactant. The exact reason for this, however, is not fully understood.

As indicated, halide ions and various organosulfur-containing groups may be used as the anionic groups useful in the charge agents of the invention. Typically, such organo groups contain 1 to about 10 carbon atoms including such anions as alkyl sulfates and sulfonates, such as methyl sulfate and methane sulfonate; aryl sulfonates, such as p-toluene sulfonates; and the like.

A variety of colorant materials selected from dyestuffs or pigments may be employed in the toner materials of the present invention. Such materials serve to color the toner and/or render it more visible. Of course, suitable toner materials having the appropriate charging characteristics can be prepared without the use of a colorant material where it is desired to have a developed image of low optical opacity. In those instances where it is desired to utilize a colorant, the colorants used, can, in principle, be selected from virtually any of the compounds mentioned in the *Colour Index* Volumes 1 and 2, Second Edition.

Included among the vast number of useful colorants would be such materials as Hansa Yellow G (C.I. 11680), Nigrosine Spirit soluble (C.I. 50415), Chromogen Black ETOO (C.I. 45170), Solvent Black 3 (C.I. 26150), Fuchsine N (C.I. 42510), C.I. Basic Blue 9 (C.I. 52015), etc. Carbon black also provides a useful colorant. The amount of colorant added may vary over a wide range, for example, from about 1 to about 20 percent of the weight of the polymeric binder. Particularly good results are obtained when the amount is from about 2 to about 10 percent. In certain instances, it may be desirable to omit the colorant, in which case the lower limit of concentration would be zero.

The toners of this invention can be mixed with a carrier vehicle to form developing compositions. The carrier vehicles which can be used with the present toners to form new developer compositions can be selected from a variety of materials. Suitable carrier vehicles useful in the invention include various nonmagnetic particles such as glass beads, crystals of inorganic salts such as sodium or potassium chloride, hard resin particles, metal particles, etc.

In addition, magnetic carrier particles can be used in accordance with the invention. In fact, the toner compositions of the present invention are especially suited for use with magnetic carrier particles as the problem of "toner throw-off" is especially bothersome in magnetic brush development processes. Suitable magnetic carrier particles are particles of ferromagnetic materials such as iron, cobalt, nickel, and alloys and mixtures thereof. Other useful magnetic carriers are mixtures of rough-surfaced, irregularly shaped magnetic particles and smooth-surfaced, regularly-shaped magnetic particles such as described in Trachtenberg et al, U.S. Pat. No. 3,838,054, issued Sept. 24, 1974. Other useful magnetic carriers are particles wherein each individual carrier particle contains a plurality of magnetic particles uniformly dispersed throughout an electrically insulating polymeric matrix such as described in Canadian Pat. No. 835,317 dated Feb. 24, 1970. Other useful magnetic carriers are ferromagnetic particles overcoated with a thin layer of various film-forming resins, for example, the alkali-soluble carboxylated polymers described in Miller, U.S. Pat. No. 3,547,822 issued Dec. 15, 1970. Still other useful resin coated magnetic carrier particles are described in Miller, U.S. Pat. No. 3,632,512 issued Jan. 4, 1972; McCabe, U.S. Pat. No. 3,795,617, issued Mar. 5, 1974, entitled "Electrographic Carrier Vehicle and Developer Composition—Case B;" and Kasper U.S. Pat. No. 3,795,618, issued Mar. 5, 1974, entitled, "Electrographic Carrier Vehicle and Developer Composition—Case D". Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

A typical developer composition containing the above-described toner and a carrier vehicle generally comprises from about 1 to about 10 percent by weight of particulate toner particles. Typically, the carrier particles are larger than the toner particles. Conventional carrier particles have a particle size on the order of from about 30 to about 1200 microns, preferably 60–300 microns.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as a receiver sheet. One suitable development technique involves cascading the developer composition across the electrostatic charge pattern; while another technique involves applying toner particles from a magnetic brush. This latter technique involves the use of a magnetically attractable carrier vehicle in forming the developer composition. After imagewise deposition of the toner particles, the image can be fixed by heating the toner to cause it to fuse to the substrate carrying the toner. If desired, the unfixed image can be transferred to another support such as a blank sheet of copy paper and then fixed to form a permanent image.

The following examples are included for a further understanding of the invention.

EXAMPLE 1

In this example a charge control agent of the present invention was compared to tetrapentylammonium chloride, the highly useful charge control agent described in Jadwin et al, Ser. No. 399,266, filed Sept. 20, 1973.

Toner A (Prior art)

- 100 parts poly(styrene-co-methyl methacrylate-co-ethylhexyl methacrylate)—polymeric binder
- 0.5 parts Tetrapentylammonium chloride—charge agent
- 5 parts Regal 300R ® carbon black purchased from Cabot Corp.—colorant Toner B (Present invention)

- 100 parts poly(styrene-co-methyl methacrylate-co-ethylhexyl methacrylate)—polymeric binder
- 0.5 parts (3-lauramidopropyl)trimethylammonium methyl sulfate—charge agent
- 5 parts Regal 300R ® carbon black—colorant Toners A and B were prepared by melt blending the addenda on a 2-roll mill, cooling the material, and then grinding in a fluid energy mill to an average size of between 3 to 15 microns.

In the melt-blending preparation of both Toners A and B, the coolant and charge agent were added in an identical manner during the melt-blending operation. Upon analysis of the Toner A composition, it was found that the concentration of the charge agent in Toner A at or near the exterior surface of the Toner A particles was equivalent to that which one would expect assuming the charge agent was dispersed in a uniform manner throughout the Toner A particle composition during melt blending. However, upon analysis of the composition of Toner B, it was found that the concentration of the charge agent in Toner B at or near the exterior surface of the Toner B particles was much greater than the aforementioned concentration of charge agent found at or near the surface of the Toner A particles.

Toners A and B were employed in a magnetic brush developer mix containing 3 weight percent toner and 97 percent by weight of magnetic carrier particles composed of Hoeganaes EH sponge iron particles (average particle size ~125 microns) partially coated with a fluorocarbon resin. The developer mixes containing Toners A and B were labelled Developer A and Developer B, respectively.

The effective charge (μcoul/gram) of these developers was measured at various RH levels and the results of these measurements are shown in FIG. 1. It will be noted that in a useful triboelectric charge range of 8–35 μcoul/gram, Developer B (containing the charge agent of the present invention) is operable at a wider range of relative humidities than is Developer A.

EXAMPLE 2

In this example, Developer A and Developer B (as described in Ex. 1) were separately tumbled for 15 minutes and their triboelectric charge measured. The developers were then allowed to rest undisturbed for 3 days and their charge again measured. The results are given in Table I:

TABLE I

| Developer | Charge After Tumbling 15 Minutes (μcoul/gram) | Charge After 3 Days (μcoul/gram) | % Charge Decay |
|---|---|---|---|
| A (Prior Art) | 29.6 | 22.9 | −23% |
| B (Present Invention) | 22.2 | 19.7 | −11% |

Table I shows that the charge decay of Developer B is significantly lower than that of Developer A. Minimal charge decay is important for a developer mix used in an electrographic copier to obtain uniform initial print quality upon start-up of the copier after shutting down for an extended period, such as a weekend.

EXAMPLE 3

Two charge agents were tested with a Thermo Gravimetric Analyzer (TGA) to determine their decomposition temperature. The results are given in Table II:

TABLE II

| Charge Agent | Decomposition Temperature (°C.) |
|---|---|
| Tetrapentylammonium Chloride (prior art) | 181 |
| (3-lauramidopropyl)trimethylammonium methyl sulfate (present invention) | 279 |

Table II shows that the above-noted charge agent of the present invention has a higher decomposition temperature than tetrapentylammonium chloride of the prior art. This higher decomposition temperature eliminates degradation problems during compounding of the charge agent into the toner.

EXAMPLE 4

Two toners of the following composition were prepared in a manner similar to Example 1:

Toner C (present invention)

- 100 parts styrene containing polymeric binder
- 0.5 parts (3-lauramidopropyl)trimethylammonium methyl sulfate
- 5 parts Regal 300 R ® carbon black Toner D (prior art)

Figure 2:
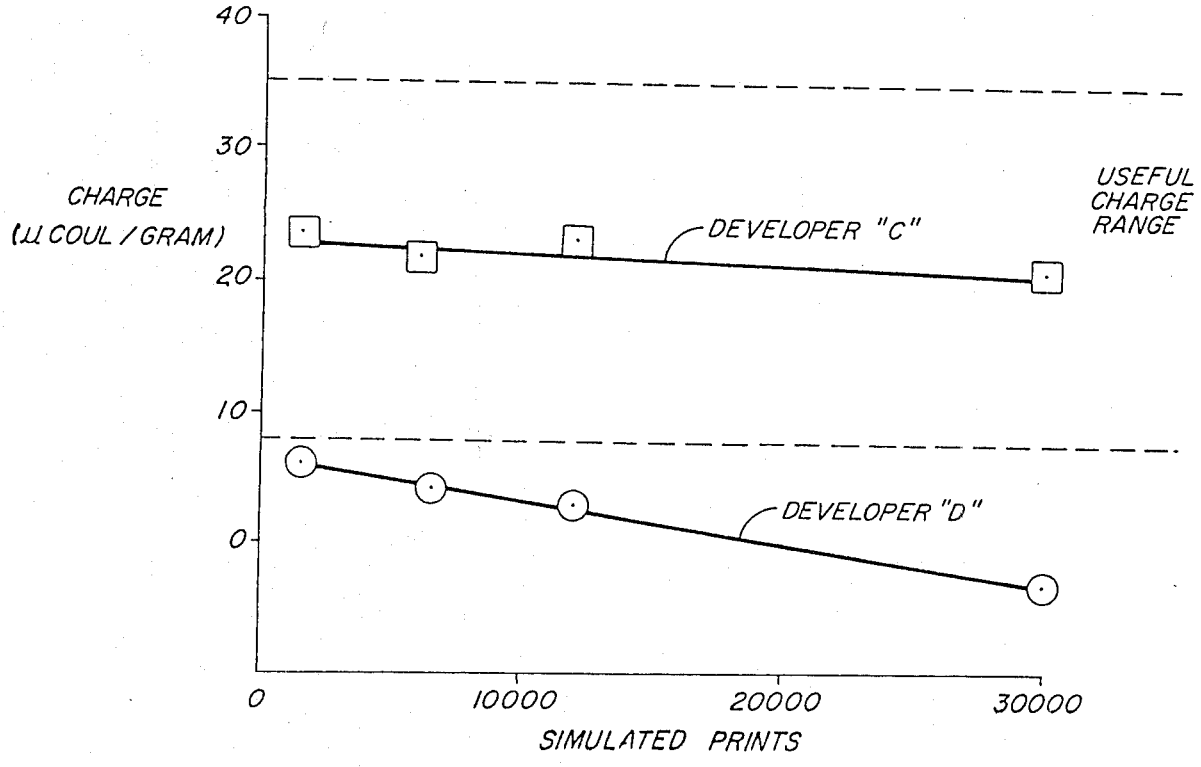
FIG. 2 is a graph illustrating the effect on the net toner charge of two developer compositions, C and D, subjected to an identical simulation test representing a 30,000 print run on an electrophotographic document copier. The difference between the two developer compositions tested is that Developer D employs a toner composition containing no charge control agent and Developer C employs a toner composition identical to that of Developer D except that a charge control agent of the present invention is added thereto.

- 100 parts styrene-containing polymeric binder
- 5 parts Regal 300R ® carbon black Toners C and D were used at 3 weight percent concentration in a magnetic brush developer mix as described in Example 1. These developers were then put through a simulated 30,000 print run. The data (FIG. 2) indicates that Developer C containing the charge agent of the present invention would be electrically stable over this period, but that prior art Developer D would not.

EXAMPLE 5

A number of dry toner formulations were prepared as in Example 1 in order to define the effective concentration range of the subject charge agent. These toner formulations represented a concentration series using (3-lauramidopropyl)-trimethylammonium methyl sulfate, a representative charge agent of the present invention, at levels varying from 0 to 2 parts by weight based on 100 parts by weight polymeric binder contained in the toner formulations. The toner particle formulations were prepared and tested for charge and throw-off characteristics. The data indicated that the preferred concentration range is approximately 0.2 to 1.5 parts equivalent to approximately 0.2 to 1.5 percent by weight of charge agent based on the total weight of the toner formulations.

EXAMPLE 6

A number of toners were prepared as in Example 1 except using different charge control agents and developers were made as in Example 1. The effective charge of these developers was measured at various RH levels and the results of these measurements are tabulated in Table III below.

The charge control agents were prepared according to the following procedure:

Synthesis of (3-lauramidopropyl)trimethylammonium methylsulfate 0.036 moles (10.3 g) N-(3-dimethylaminopropyl)-lauramide and 25 ml acetone were placed in a 100 ml round bottom flask. 0.036 moles (3.4 ml) dimethylsulfate was added slowly to the flask, a condenser attached, and the reaction mixture refluxed for two hours. After cooling, the product crystallized out of the acetone, was filtered off, and recrystallized from acetone to a constant melting point. Melting point 98.5°-100° C.

Synthesis of N-(3-dimethylaminopropyl)lauramide 0.2 moles (43.8 g) lauroyl chloride in 50 ml benzene was added slowly with stirring and cooling to 0.2 moles (20.4 g) N,N-dimethyl-1,3-propanediamine in 350 ml benzene. The temperature was kept below 30° C. When all of the acid chloride had been added, the reaction mixture was heated at reflux for one hour. The HCl salt that had formed was extracted from the benzene with several portions of water. The water was made basic with $Na_2SO_3$. The desired product, N-(3-dimethylaminopropyl)lauramide was extracted from the water phase with fresh benzene. The product was then isolated by removing the solvent.

Melting point 35°-37° C.

Anal. elemental analysis for $C_{17}H_{36}N_2O$, m.w. 285:

Calc. C-71.8 H-12.8 N-9.8 Found C-2.70 H-12.4 N-9.6

The other charge control agents of the present invention listed in Table III were prepared by the same general procedure as above but substituting the appropriate acid chloride and appropriate salt forming reagent.

TABLE III

| | Charge Control Agent | Triboelectric Charge (μcoul/g) 0% RH | 50% RH | 90% RH |
|---|---|---|---|---|
| 1. | (3-caprylamidopropyl)trimethylammonium methyl sulfate | 18.2 | 20.4 | 6.8 |
| 2. | (3-caprylamidopropyl)trimethylammonium iodide | 24.2 | 21.6 | 9.8 |
| 3. | (3-caprylamidopropyl)trimethylammonium p-toluene sulfonate | 16.7 | 19.7 | 6.2 |
| 4. | (3-lauramidopropyl)dimethylammonium ethyl sulfate | 20.5 | 21.8 | 7.0 |
| 5. | (3-lauramidopropyl)trimethylammonium methyl sulfate | 23.9[a]<br>22.9[b] | 20.7[a]<br>21.9[b] | 12.1[a]<br>10.2[b] |
| 6. | (3-arachidamidopropyl)trimethylammonium methyl sulfate | 30.3 | 21.7 | 11.9 |
| 7.* | tetrapentylammonium chloride | 49.9 | 33.1 | 15.5 |
| 8.* | (3-stearamidopropyl)dimethyl-β-hydroxy-ethylammonium nitrate | 37.9 | 27.3 | 15.0 |

*Compounds not within the scope of the present invention.
[a]Compound prepared in the laboratory.
[b]Compound available commercially as Catanac LS from the American Cyanamide Co.

The representative charge agents of the present invention illustrated in this example all exhibit good RH stability within the useful magnetic brush developer charge range of about 8 to about 35 microcoulombs per gram.

The invention has been described in detail with particular reference to certain preferred embodiments thereof, but it will be understood that variations and modifications can be effected within the spirit and scope of the invention.

I claim:

1. A dry, particulate, electrostatic toner composition having a particle size from about 0.1 to about 100 microns and comprising (a) a polymeric binder having a softening temperature from about 40° C. to about 200° C. and (b) from about 0.01 to about 2 percent by weight of a quaternary ammonium salt surfactant of the formula:

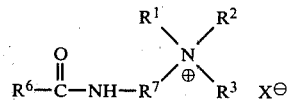

wherein:

$R^1$, $R^2$, and $R^3$ are the same or different lower alkyl groups;

$R^6$ is an alkyl group having 7 or more carbon atoms;

$R^7$ is a straight chain alkylene group having from 1 to about 8 carbon atoms; and $X^\ominus$ is a halide ion or an organosulfur-containing anion of the formula $R^5SO_n$ wherein $R^5$ is an aliphatic or aromatic group having up to about 10 carbon atoms and n is 3 or 4, the amount of said quaternary ammonium salt being effective to provide an electrostatic toner that is capable of maintaining a relatively high, stable net toner charge level under widely varying relative humidity conditions.

2. A composition as defined in claim 1 in which $R^6$ is an alkyl group having from about 7 to about 11 carbon atoms.

3. A composition as defined in claim 1 in which said quaternary ammonium salt surfactant is selected from the group consisting of:

(3-caprylamidopropyl)trimethylammonium methyl sulfate;

(3-caprylamidopropyl)trimethylammonium iodide;

(3-caprylamidopropyl)trimethylammonium p-toluene sulfonate; and (3-lauramidopropyl)trimethylammonium methyl sulfate.

4. A composition as defined in claim 1 in which said quaternary ammonium salt surfactant is (3-lauramidopropyl)trimethylammonium methyl sulfate.

5. A composition as defined in claim 1 in which the binder is a styrene copolymer and which contains carbon black as a pigment.

6. A dry, particulate electrostatic toner composition having a particle size from about 0.1 to about 30 microns and comprising (a) a polymeric binder, (b) a pigment or dyestuff in an amount sufficient to color the particles, and (c) from about 0.01 to about 2 percent by weight of said composition of a quaternary ammonium salt of the formula:

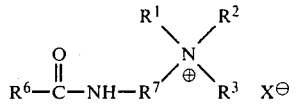

wherein:

$R^1$, $R^2$ and $R^3$ are the same or different alkyl groups, each having from 1 to about 4 carbon atoms;

$R^6$ is an alkyl group having from about 7 to about 11 carbon atoms;

$R^7$ is a straight-chain alkylene group having from 1 to about 8 carbon atoms; and $X^\ominus$ is a halide ion or an organosulfur-containing anion of the formula $R^5SO_n$ wherein $R^5$ is an alkyl or aryl group having up to about 10 carbon atoms and n is 3 or 4.

7. A dry, electrostatic toner composition as defined in claim 6 in which said quaternary ammonium salt is (3-lauramidopropyl)trimethylammonium methyl sulfate.

8. An electrographic developer composition comprising (a) magnetic carrier particles having a particle size within the range from about 30 to about 1200 microns and (b) toner particles which are electrostatically attractable to the carrier particles, said toner particles having the composition defined in claim 1.

9. An electrographic developer composition as defined in claim 8 in which $R^6$ of the quaternary ammonium salt is an alkyl group having from about 7 to about 11 carbon atoms.

10. An electrographic developer composition as defined in claim 9 in which the quaternary ammonium salt is (3-lauramidopropyl)trimethylammonium methyl sulfate.

* * * * *